US005290969A

United States Patent [19]

Kobayashi

[11] Patent Number: 5,290,969

[45] Date of Patent: Mar. 1, 1994

[54] MUSICAL TONE SYNTHESIZING APPARATUS FOR SYNTHESIZING A MUSCIAL TONE OF AN ACOUSTIC MUSICAL INSTRUMENT HAVING A PLURALITY OF SIMULTANEOUSLY EXCITED TONE GENERATING ELEMENTS

[75] Inventor: Kaoru Kobayashi, Hamamatsu, Japan

[73] Assignee: Yamaha Corporation, Hamamatsu, Japan

[21] Appl. No.: 619,202

[22] Filed: Nov. 28, 1990

[30] Foreign Application Priority Data

Nov. 29, 1989 [JP] Japan ..... 1-309870

[51] Int. Cl.[5] ..... G10H 1/12

[52] U.S. Cl. ..... 84/622; 84/625; 84/660; 84/DIG. 10; 84/DIG. 26

[58] Field of Search ..... 381/63; 84/600, 601, 84/DIG. 9, DIG. 10, 26, 622, 624, 625, 659, 660

[56] References Cited

U.S. PATENT DOCUMENTS 4,130,043 12/1978 Niimi ..... 84/DIG. 10
4,475,229 10/1984 Frese ..... 381/63
4,984,276 1/1991 Smith ..... 381/63

FOREIGN PATENT DOCUMENTS 63-40199 2/1988 Japan .

OTHER PUBLICATIONS

"The Sound Production Mechanism of the Piano Using a Digital Filter by Computer Simulation", *13th International Congress on Acoustics,* Isao Nakamura, et al., 1989, pp. 65-68.

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus generates musical tones by simulating the tone generation construction of a plucked-stringed instrument or percussion type stringed instrument. The apparatus has a plurality of closed loop circuits which simulate each tone generating element of the instrument, an excitation circuit which creates an excitation signal corresponding to the excitation given to the plurality of tone generating elements in response to the operation of a tone generating operator or the operational information of the tone generating operator, and a memory which stores a nonlinear relation between the tone generating elements and the tone generating operator such as a hammer. The excitation signal is supplied to each of the closed loop circuits and circulates around each closed loop circuit and is delayed by means of a delay circuit having delay interval, and is fed back into the excitation circuit as the state of the tone generating elements. By varying the delay time of each delay circuit, the beat between the musical tones taken out from each closed loop circuit can be generated.

10 Claims, 3 Drawing Sheets

MUSICAL TONE SYNTHESIZING APPARATUS FOR SYNTHESIZING A MUSCIAL TONE OF AN ACOUSTIC MUSICAL INSTRUMENT HAVING A PLURALITY OF SIMULTANEOUSLY EXCITED TONE GENERATING ELEMENTS

BACKGROUND OF THE INVENTION

1. Field of the Invention

The present invention relates to a musical tone synthesizing apparatus which is applicable to synthesis of the musical tones of plucked stringed instruments, percussion type stringed instruments and other musical instruments of this type.

2. Prior Art

Devices are well known wherein, through simulation of the tone generation mechanisms of an acoustic musical instrument, the sound of these acoustic musical instruments can be synthesized.

As an example, devices for synthesis of the sound of stringed instruments have been described, consisting of a low-pass filter for simulating reverberation losses in the strings, and a delay circuit for simulating propagation delays of the vibration of the strings, the low-pass filter and delay circuit being connected so as to form a closed loop. With such a device, an excitation signal, for example an impulse signal, is introduced into the closed loop. Thus introduced, the impulse signal circulates about the closed loop with a period equal to the frequency at which the strings under simulation would vibrate in the actual stringed instrument. The bandwidth of the signal is restricted each time it traverses the low-pass filter, and finally, the signal is output from the closed loop as a signal corresponding to the tone of the stringed instrument being synthesized.

with the device described above, by adjusting the delay period of the delay circuit and the characteristics of the low-pass filter, the sound of a plucked stringed instrument such as a guitar, or of a percussive stringed instrument such as a piano can be synthesized, having characteristics very close to those of the target instrument. When simulating the sound of a stringed instrument played with a bow such as a violin, the excitation signal is introduced into the closed loop from an excitation circuit, wherein a signal is generated simulating the effect of the bow. Examples of this type of musical tone synthesizing apparatus include those disclosed in Japanese Patent Application, Laid-open No. 63-40199 and U.S. Pat. No. 4,130,043.

With the conventional musical tone synthesizing device described above, each closed loop formed by the low pass filter and delay circuit is only capable of synthesizing the sound of one string at any given moment. Thus, these conventional devices model an instrument for which only one string is struck, plucked, or otherwise caused to vibrate at one time. For the above reason, such a device cannot realized the sound effect of, for example, an acoustic piano of which three strings corresponding to one of lower keys are struck at one time, wherein each strings being tuned so as to create slight discrepancies in tuning between each of the three strings to thereby realize beat effect. The above described conventional devices would of course not be able to simulate such an effect. Thus these devices are considerably limited in their ability to faithfully reproduce the sound of various conventional stringed instruments.

SUMMARY OF THE INVENTION

In consideration of the above described shortcomings of conventional devices for synthesizing the sound of stringed instruments, a primary object of the present invention is to provide a musical tone synthesizing apparatus in which the effect of two or more strings simultaneously vibrating can be achieved.

A further object of the present invention is to provide a musical tone synthesizing apparatus which can faithfully reproduce the sound of a conventional stringed instrument.

In one implementation of the present invention, an apparatus for generating the sound of an acoustic musical instrument is provided, where the acoustic musical instrument consists of a plurality of tone generating elements and one or more tone generating operators for simultaneously exciting one or more of the tone generating elements to thereby create reciprocally propagating vibrations within the excited tone generating elements. The apparatus according to this implementation of the present invention is comprised of:

(a) a plurality of a closed loop circuits, each closed loop circuit comprising delay means having delay interval required for circulating in the entire loop which is equal to the period of reciprocal propagation vibration in one of the tone generating element of the above mentioned acoustic musical instrument;

(b) excitation means wherein excitation signals are generated in accordance with operation data and supplied simultaneously to the above mentioned plurality of closed loop circuits, such that the above mentioned operation data correspond to operation data supplied to the above mentioned tone generating operators in the acoustic musical instrument being simulated, and the above mentioned excitation signals correspond to the excitation of the tone generating elements by the tone generating operators in the acoustic musical instrument.

The preferred embodiments of the present invention are described in a following section with reference to the drawings, from which further objects and advantages of the present invention will become apparent.

DETAILED DESCRIPTION OF THE PREFERRED EMBODIMENTS

[A] CONFIGURATION OF EMBODIMENT

In the following section, a first preferred embodiment of the present invention will be described with reference to FIGS. 1 through 4.

Figure 1:
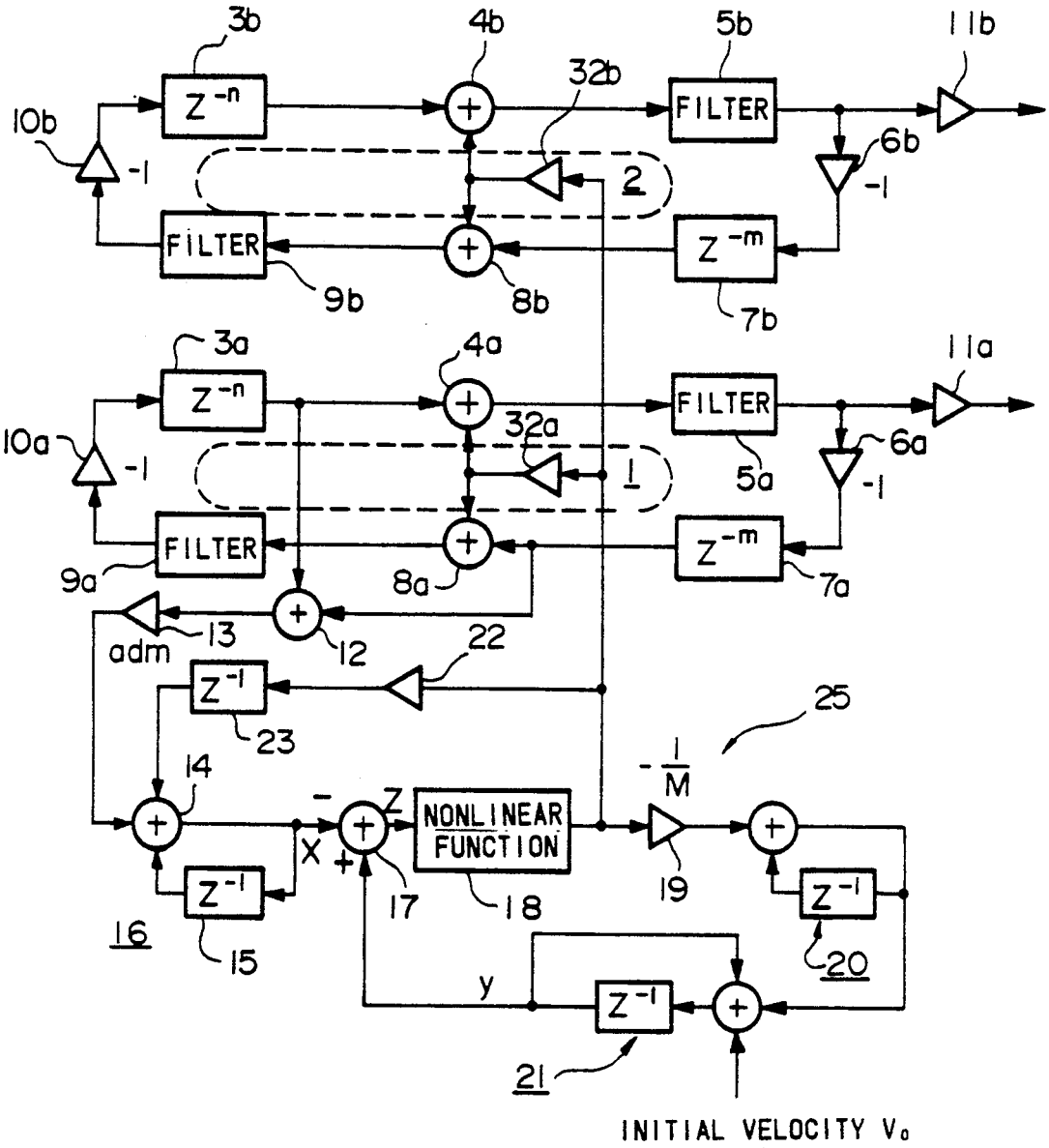
FIG. 1 is a block diagram showing the configuration of a musical tone synthesizing apparatus according to an preferred embodiment of the present invention.

In FIG. 1, a block diagram is shown illustrating the general layout of the musical tone synthesizing apparatus of the present embodiment. The apparatus shown in this drawing is suitable for simulating the sound of a percussive stringed instrument such as a piano. In this simplified diagram, only two closed loops circuits are shown, closed loop circuits 1 and 2. As can be seen from FIG. 1, closed loop circuit 1 is made up of delay circuit 3*a*, adder 4*a*, filter 5*a*, phase inverter 6*a*, delay circuit 7*a*, adder 8*a*, filter 9*a* and phase inverter 10*a*. Similarly, closed loop circuit 2 is made up of delay circuit 3*b*, adder 4*b*, filter 5*b*, phase inverter 6*b*, delay circuit 7*b*, adder 8*b*, filter 9*b* and phase inverter 10*b*. Each closed loop circuit 1, 2 simulates the vibration of an individual piano string, and hence corresponds to one string in the instrument being simulated.

To describe the operation of the above described the closed loop circuits 1 and 2 in greater detail, reference will be made to FIG. 2, wherein the interaction of a hammer HM and a corresponding string S in a piano is schematically illustrated. Each end of the piano string S is secured at a respective fixation point T1 or T2. Conventionally, in a piano, each hammer is operated through the action of a single corresponding key on the keyboard of the piano. Thus, when a given key is depressed, the corresponding hammer strikes the one or more strings associated with that hammer. Each string S having been thus struck by the hammer HM thereby receives mechanical energy which has been imparted by the striking hammer, this mechanical energy manifested as vibrational waves Wa, Wb, each initially traveling away from the hammer HM in opposite directions, propagating along string S.

In the case of the musical tone synthesizing apparatus shown in FIG. 1, assuming that the closed loop circuit 1 is simulating the above mentioned string S, the delay interval of the delay circuit 3*a* corresponds to the time required for the vibrational wave Wa to travel from the striking position to the fixation point T1 where it is reflected, and then back to the striking position, i.e., time for circulating. Similarly, the delay interval of the delay circuit 7*a* corresponds to the time require for the vibrational wave Wb to travel from the striking position to the fixation point T2 and then back to the striking position. The phase inverters 6*a*, 10*a* in the musical tone synthesizing apparatus correspond to the fixation points T1 or T2, respectively, for the string S being simulated, and function to simulate the phenomena of reverse phase reflection of the vibrational waves Wa, Wb at the fixation points T1 and T2. In this way, the time required for the signal corresponding to a given excitation signal Ws' to completely traverse the closed loop is equal to the period of the standing wave Ws in the string S. The signal which propagates within closed loop 1 oscillating at a frequency corresponding to the pitch of vibrating string S is supplied from closed loop circuit 1 to an amplifier via multiplier 11*a* wherein the signal is amplified. In other words, the signal which propagates in the closed loop circuit 1 is outputted and amplified as a musical tone signal with a pitch which corresponds to the length of the string S.

As the signal continues to propagate about the closed loop circuit 1, the effect of diminishing amplitude of vibration with time which occurs in the actual string S is simulated through the action of the filters 5*a* and 9*a*. In particular, through the operation of the filters 5*a* and 9*a*, the phenomena of selectively greater decay in amplitude of the higher frequency harmonics in an actual string S is reproduced with fidelity. In the same way, the closed loop circuit 2 is capable of simulating the vibration of a second string vibrating simultaneously with string S.

Again referring to FIG. 1, the operation of the closed loop circuit 1 will be described in terms of digital components incorporated therein. The delay circuits 3*a* and 7*a* consist of shift registers comprised of multiple flip-flops, each flip-flop corresponding to a bit in the propagating signal. A sampling clock pulse is supplied at fixed intervals to each of the flip-flops. In FIG. 1, indicating letters m and n correspond to the number of registers in delay circuits 3*a* and 7*a* respectively. In addition to the delay circuits 3*a* and 7*a*, the other components shown in FIG. 1 are digital devices.

The output signals of the delay circuits 3*a* and 7*a* (corresponding to excitation signals) are supplied to excitation circuit 25 which is made up of multiplier 13, integrating circuit 16, subtracter 17, ROM (read only memory) 18, multiplier 19 and integrating circuits 20 and 21. The output signal of the delay circuit 3*a* and that of the delay circuit 7*a*, i.e., the excitation signals, are summed in adder 12, the result of which is outputted as velocity signal $V_{s1}$ which corresponds to the vibration velocity in string S. Velocity signal $V_{s1}$ thus outputted from adder 12 is then multiplied in multiplier 13 by a multiplication coefficient adm to be discussed later.

The result of the multiplication operation in the multiplier 13 is then supplied to adder 14. Additionally, a signal F which corresponds to the repulsive force imparted to the hammer HM by the string S in the acoustic musical instrument being synthesized is supplied to the adder 14, via the multiplier 22 and single sample period delay circuit 23. The adder 14 together with a single sample period delay circuit 15 form the integration circuit 16 wherein the above described signal F and the output signal of the multiplier 13 are integrated.

Figure 2:
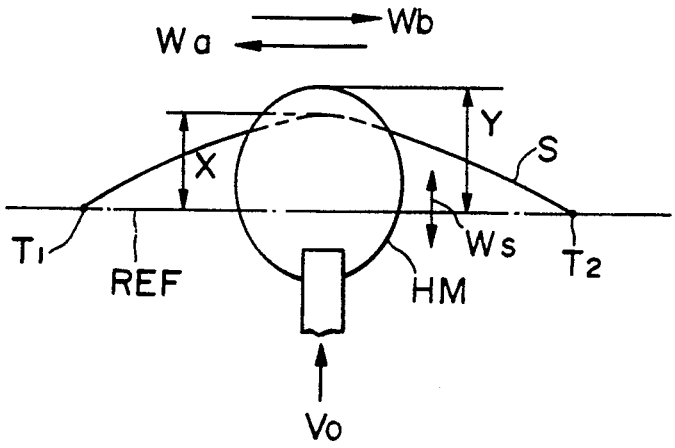
FIG. 2 is a view schematically illustrating the interaction between a hammer and a string in a piano which is simulated by the musical tone synthesizing apparatus shown in FIG. 1.

The result of integration in the integration circuit 16 constitutes a string displacement signal x which corresponds to the displacement X of the string S from a baseline position REF as shown in FIG. 2. The above described string displacement signal x is supplied to one input terminal of the subtracter 17. To the other input of subtracter 17, a hammer displacement signal y is supplied from an integrator 21 which will be described later, the hammer displacement signal y corresponding to the displacement Y of the hammer HM as shown in FIG. 2. In the subtracter 17, the string displacement signal x is subtracted from the hammer displacement signal y, whereby a difference signal z is calculated and outputted, corresponding to the relative displacement between the hammer HM and string S. The above described difference signal z thus calculated is then supplied to the ROM 18.

Positive values for the difference signal z correspond to the state in which the hammer HM indents by the string S. To the extent that the difference signal z is a large positive value, the amount of indentation of the hammer HM by the string S represented by the difference signal z is large, and a correspondingly large value is obtained for the signal F which represents the repulsive force imparted to the hammer HM by the string S. The difference signal z value of zero represents the case where the hammer HM is lightly in contact with the string S, but does not indent thereby. Negative values for the difference signal z represent the case where the hammer HM is separated from string S. Signal F which represents the repulsive force imparted to the hammer HM by the string S is zero when difference signal z is zero or negative, that is, when simulated string S is not indented by the hammer HM.

As described above, the difference signal z is supplied to the ROM 18 after calculation thereof. In the ROM 18, data is stored representing a non-linear function B which describes the relation between the signal F and the difference signal z, in other words, the relation between amount of indentation of the hammer HM by the string S and repulsive force exerted on the hammer HM by the string S.

Figure 3:
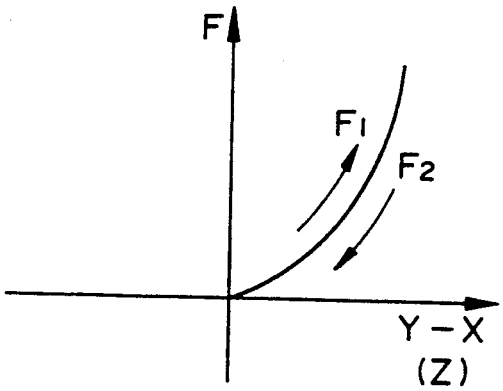
FIG. 3 is a waveform diagram depicting a nonlinear function for describing an aspect of the musical tone synthesizing apparatus shown in FIG. 1.

An example of the non-linear function B is graphically represented in FIG. 3 wherein the value of the signal F is shown as a function of the difference signal z for the hammer HM which has been constructed from a relatively soft material such as felt. As mentioned above and as shown in the graph of FIG. 3, the repulsive force exerted on the hammer HM as expressed by the signal F is zero when difference signal z is zero or negative, that is, when simulated string S is separated from or only lightly touching hammer HM. In the acoustic instrument being simulated, hammer HM is indented by string S by an amount proportional to the force with which the hammer HM strikes string S. Thus, with striking of the string S with progressively greater force, the difference signal z representing the amount of indentation of hammer HM attains progressively greater values. Accordingly, the signal F gradually increases for progressively greater striking force. Non-linear function B is such that when representing a hammer HM which has been constructed from a relatively hard material, for example wood, the value of the signal F rises much more rapidly with increasing striking force.

As thus described, the signal F is outputted from the ROM 18 after an arbitrary time lapse following the simulated striking of the string S by the hammer HM. The signal F thus output is then supplied to adders 4*a* and 8*a*, and to adders 4*b* and 8*b* via respective multipliers 32*a* and 32*b*. The signal F is also supplied to a multiplier 19 wherein the signal is multiplied by a multiplication coefficient given by $-1/M$. The term M in the denominator of the above mentioned multiplication coefficient corresponds to the mass of the hammer HM. The output of multiplier 19 is acceleration signal $\alpha$ which corresponds to the acceleration of the hammer HM. The acceleration signal $\alpha$ is supplied to an integrator 20 where the signal is integrated and then outputted to an integrator 21 as signal $\beta$ which corresponds to the change in velocity of the hammer HM. In integrator 21, the result of the adding signal $\beta$ and an initial velocity signal $V_0$ which corresponds to the initial velocity of the hammer HM is integrated, whereby the above mentioned hammer displacement signal y is obtained, after which it supplied to subtracter 17, as previously described. The initial velocity signal $V_0$ is generally generated by detecting initial status of a key such as an initial touch of a key.

As mentioned above, the signal F is output from the ROM 18 and supplied to adders 4*a* and 8*a*, and to adders 4*b* and 8*b* via respective multipliers 32*a* and 32*b*. In this way, the signal F comes to be added to excitation the signals Ws' which are circulating around the closed loop 1 and/or closed loop 2. It is possible to calculate the change in velocity of the string S by multiplying the signal F which corresponds to the repulsive force exerted on the hammer HM by the string S with a multiplication coefficient which corresponds to the resistance to change of velocity of string S, after which the change in velocity of string S thus calculated can be input into the closed loops 1 and 2. In the case of the present embodiment, however, the previously mentioned multiplication coefficient adm incorporates a factor dependent on the above mentioned resistance to change of the velocity of the string S, whereby the same effect is achieved.

[B] OPERATION OF EMBODIMENT

In the following section, the operation of the above described embodiment of the present invention will be explained.

First of all, prior to tone generation, the delay interval of each the delay circuit 3*a*, 3*b*, 7*a*, 7*b* is set to an appropriate initial value. Additionally, the single sample period delay circuit included as part of each integration circuit 16, 20, 21 is reset to zero.

With the various circuits thus initialized, an initial velocity signal $V_0$ corresponding to the initial velocity of the hammer HM is outputted from a musical tone generation control circuit (not shown in drawings) and supplied to the integrator 21 wherein it is integrated, thus yielding the previously described hammer displacement signal y. Immediately following input of the initial velocity signal $V_0$ to the integrator 21, hammer displacement signal y outputted therefrom is negative and approaching zero with passage of time, in this way expressing the motion of the hammer HM toward the stationary string S prior to contact therewith in the acoustic instrument being simulated.

Up to the time when hammer displacement signal y reaches zero, representing the period before the hammer HM makes contact with the string S, difference signal z has a negative value. The signal F outputted from the ROM 18 is zero when the input signal supplied thereto is zero or negative, as is shown in FIG. 3. For this reason, the signal F which is supplied to multiplier 19, the signal $\alpha$ outputted from multiplier 19 and supplied to the integrator 20, as well as the signal $\beta$ outputted from the integrator 20 have values of zero. Because the signal $\beta$ outputted from the integrator 20 and supplied to the integrator 21 has a value of zero over this interval, only the initial velocity signal $V_0$ is integrated in the integrator 21 up to the point in time representing contact of the hammer HM with string S.

After difference signal z reaches a value of zero, corresponding to the initial contact of the hammer HM with the string S, the signal z continues to increase in magnitude, and increasingly large values for the signal F are outputted from the ROM 18 in response thereto, where the signal F corresponds to the magnitude of the repulsive force exerted on the hammer HM by the string S. The signal F increasing in magnitude as described above is then supplied to multiplier 19 and to the closed loop circuits 1 and 2.

In the multiplier 19, the signal F is multiplied by $-1/M$ to yield the acceleration signal $\alpha$ which is negative, thereby reflecting the fact that the hammer HM decelerates upon impact with the string S. The acceleration signal $\alpha$ is integrated in the integrator 20 to yield the signal $\beta$ which corresponds to change in the velocity of hammer HM and which is also negative when representing a decelerating hammer HM. At the point when the signal $\beta$ acquires a negative value, the signal is integrated in the integrator 21. Due to the fact that the signal $\beta$ has a negative value at this point in time, as both the initial velocity signal $V_0$ and signal $\beta$ are supplied to the integrator 21, the velocity signal $V_0$ is decremented therein by an amount equal to the absolute value of signal $\beta$, after which the result thereof is integrated and outputted, whereby a newly calculated value for the hammer displacement signal y is supplied to the subtracter 17.

In the subtracter 17, the difference signal z is calculated from the string displacement signal x and the newly calculated hammer displacement signal y and outputted and supplied to the ROM 18. A new value for the signal F is read from the ROM 18 based on the difference signal z supplied thereto, after which the signal F thus computed is supplied to multiplier 19 and added to the signals circulating in closed loop circuits 1 and 2 via multipliers 32*a* and 32*b*, respectively.

The signal circulating in closed loop circuit 1 is outputted therefrom after traversing delay circuits 3*a* and 7*a*, and supplied back to excitation circuit 25 as a feedback signal. Additionally, the signals circulating in the closed loop circuits 1 and 2 are outputted via respective multipliers 11*a* and 11*b* as musical tone signals. In the excitation circuit 25, a new value for string displacement signal x is calculated in the integrator 15 from the feedback signal thus supplied from closed loop circuit 1, after which the calculated string displacement signal x is supplied to the subtracter 17. In subtracter 17, the new value for the string displacement signal x is subtracted from the current value of the hammer displacement signal y, the result of which is supplied to ROM 18 as a new difference signal z, on which basis a new value for signal F is read from ROM 18 and outputted.

The above described operation is repeated until the absolute value of the signal $\beta$ becomes greater than the initial velocity signal $V_0$. The acceleration signal $\alpha$ outputted from the multiplier 19 and signal $\beta$ outputted from the integrator 20 attain increasingly greater negative values as difference signal z increases in magnitude. For this reason, the rate of increase of the hammer displacement signal y outputted from the integrator 21 gradually becomes smaller. At the point when the absolute value of signal $\beta$ becomes greater than the initial velocity signal $V_0$, corresponding to the point of maximum displacement of hammer HM, that is, the point at which the hammer HM momentarily stops and then reverses direction, signal F reaches its maximum value, as represented by the terminus of arrow F1 in FIG. 3.

After the signal F, which corresponds to the repulsive force imparted to the hammer HM by string S, reaches its maximum value, the hammer displacement signal y outputted from integrator 21 gradually becomes smaller, as does difference signal z and signal F, as represented by arrow F2 in FIG. 3. For this reason, the magnitude of the signals circulating in the closed loop circuits 1 and 2 gradually decreases. After the point where the hammer displacement signal y, the difference signal z and the signal F each attain a value of zero, representing the point at which hammer HM retracts from string S, hammer displacement signal y becomes negative and the excitation process has thus completed.

In the above described embodiment of the present invention, by varying the delay interval of the delay circuits in the closed loop circuits 1 and 2, a discrepancy between the frequency of the tones generated within each loop can be created, thereby creating a beat frequency when the two tones are generated together. In this way, the effect of an acoustic piano of which two or more strings are struck at one time wherein the strings being tuned with respect to one another so as to create slight discrepancies in tuning between each of the strings to thereby realize beat effect. Different tonal effects can also be achieved through changing the filter coefficients of the filters in the closed loop circuits 1 and 2, or through changing the output ratio of closed loop circuits 1 and 2 by altering the multiplication coefficients of multipliers 11*a*, 11*b*. Additionally, the previously described una chorda pedal effect can be achieved by attenuating or completely cutting the signal F supplied to one of the closed loop circuits 1, 2, with greater attenuation of the signal corresponding to greater depressing of the una corda pedal.

Figure 4:
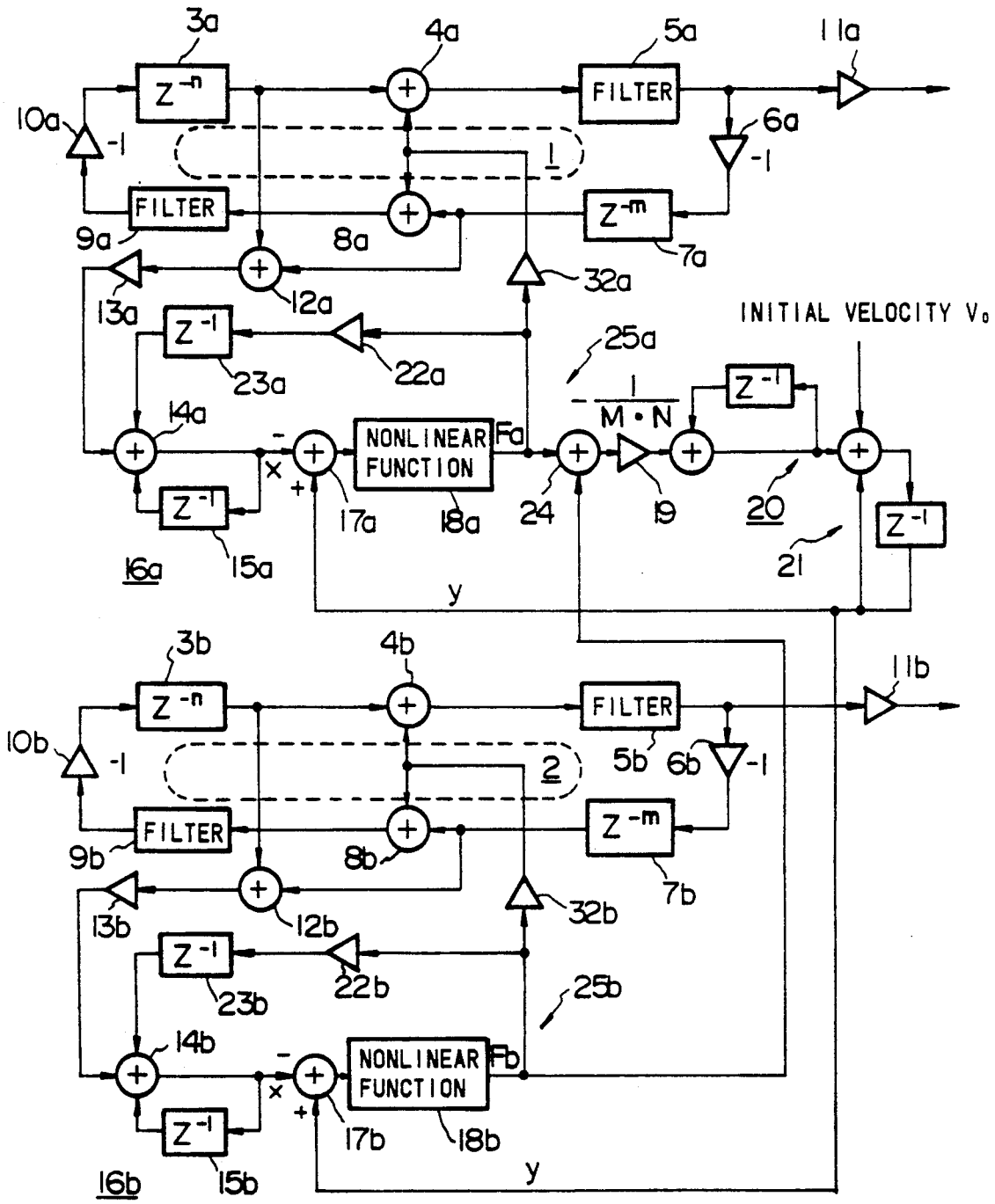
FIG. 4 is a block diagram showing a modification of the musical tone synthesizing apparatus shown in FIG. 1.

Various possible variations exist for the tone synthesizing apparatus of the present invention as described above. For example, as shown in FIG. 4, a separate excitation circuit can be provided for each closed loop circuit, excitation circuits 25*a* and 25*b*, whereby the effect of two strings is achieved, each string having unique response characteristics as governed by ROM 18*a* and ROM 18*b* included in excitation circuits 25*a* and 25*b*, respectively. By adding the signal F outputted from the ROM 18*a* and that from the ROM 18*b* in adder 24, and then multiplying that result by $-1/(M*N)$ in multiplier 19, where M corresponds to the mass of hammer HM and N is the number of strings as represented by closed loop circuits ($N=2$ in the present example), an averaged value for the acceleration signal outputted from multiplier 19 is obtained.

With the implementation of the present invention shown in FIG. 1 and that shown in FIG. 4, only two closed loop circuits were employed. It is possible, however, to employ any number of closed loop circuits, where each closed loop circuit simulates an individual string which can generate tones simultaneously with or independently of other strings as represented by the other closed loop circuits.

While the musical tone synthesizing apparatus of the present invention has been described as a digital device, the device of the present invention can be implemented in part or in total as an analog device. Additionally, a wave guide, for example, the wave guide described in Japanese Patent Application, Laid-open No. 63-40199 may be employed as a loop circuit incorporating delay elements.

In the present specification, preferred embodiments of the musical tone synthesizing apparatus of the present invention has been described. The described embodiments are meant to be illustrative, however, and are not intended to represent limitations. Accordingly, numerous variations and enhancements thereto are possible without departing from the spirit or essential character of the present invention as described. The present invention should therefore be understood to include any apparatus and variations thereof encompassed by the scope of the appended claims.

What is claimed is:

1. A musical tone synthesizing apparatus for synthesizing the musical tone of an acoustic musical instrument, of a type having a plurality of tone generating elements and tone generating operators for simultaneously exciting said tone generating elements to thereby create reciprocally propagating vibrations within said tone generating elements, said musical tone synthesizing apparatus comprising:

(a) a plurality of closed loop circuits, each closed loop circuit comprising delay means having a delay interval corresponding to the period of reciprocal propagation vibrations in one of the tone generating elements of said acoustic musical instrument, wherein said delay interval is capable of being set to have a discrepancy from the delay intervals of others of said plurality of closed loop circuits;

(b) feedback means for supplying feedback data from at least one of the plurality of closed loop circuits; and (c) excitation means for creating excitation signals, wherein said excitation signals are generated in accordance with operational data and said feedback data and are simultaneously supplied to said plurality of closed loop circuits, such that said operational data correspond to operational data supplied to said tone generating operators in said musical instrument being simulated, and said excitation signals correspond to the excitation of said tone generating elements by said tone generating operators in said acoustic musical instrument.

2. A musical tone synthesizing apparatus in accordance with claim 1 above, wherein said excitation means creates therein said excitation signals corresponding to the excitation of said tone generating elements by said tone generating operators which effect plucking of said tone generating elements.

3. A musical tone synthesizing apparatus in accordance with claim 1 above, wherein each of said plurality of closed loop circuits comprises:

(a) first delay means having a first delay interval equivalent to the time required for a vibrational wave in said tone generating element to travel from a point at which one of said tone generating elements is excited by a corresponding tone generating operator, to one end of said tone generating element, and back again to said point at which said tone generating element is excited in said acoustic instrument;

(b) second delay means having a second delay interval equivalent to the time required for a vibrational wave in said tone generating element to travel from said point at which said tone generating element is excited by said corresponding tone generating operator, to an other end of said tone generating element, and back again to said point at which said tone generating element is excited in said acoustic instrument;

(c) first inverting means for inverting the phase of an excitation signal input thereto, and outputting the phase inverted signal to the first delay means;

(d) second inverting means for inverting the phase of an excitation signal input thereto, and outputting the phase inverted signal to said second delay means;

(e) filtering means for imparting frequency characteristics to said excitation signal, said frequency characteristics corresponding to that of a tone generating element of said acoustic instrument and for providing an output signal to said first delay means;

(f) first adding means for adding the excitation signal outputted from said excitation means to the signal outputted from said first delay means and providing an output to said second delay means; and (g) second adding means for adding the excitation signal outputted from said excitation means to the signal outputted from said second delay means.

4. A musical tone synthesizing apparatus in accordance with claim 1 above, wherein each of said closed loop circuits corresponds to one tone generating element of said plurality of tone generating elements in said acoustic instrument, whereby each closed loop circuit simulates the vibration of a corresponding tone generating element.

5. A musical tone synthesizing apparatus in accordance with claim 1 above, wherein said excitation means creates therein excitation signals corresponding to the excitation of said tone generating elements by said tone generating operators effect striking of said tone generating elements.

6. A musical tone synthesizing apparatus in accordance with claim 1 above, wherein said excitation means comprises memory means for storing data representing a nonlinear function which indicates a relationship between the relative displacement between the tone generating elements and the tone generating operator in said acoustic instrument and the resiliency in operation between the tone generating elements and the tone generating operator, and which outputs said data in accordance with said relative displacement.

7. A musical tone synthesizing apparatus in accordance with claim 1 above, wherein each of said delay means has different delay intervals.

8. A musical tone synthesizing apparatus for synthesizing the sound of an acoustic musical instrument, said acoustic musical instrument being comprised of a plurality of tone generating elements and a tone generating operator for exciting at least one of said tone generating elements, thereby creating reciprocally propagating vibrations within said tone generating elements, said musical tone synthesizing apparatus comprising:

(a) a plurality of closed loop circuits, each closed loop circuit comprising a plurality of delay means and having a delay interval required for a signal to traverse said closed loop circuit one time equal to the period of reciprocal propagation vibration in one of the tone generating element of said acoustic musical instrument;

(b) memory means for storing the relation between the tone generating operator and the tone generating elements;

(c) feedback means for supplying feedback data from at least one of the plurality of closed loop circuits; and (d) excitation means for creating excitation signals, wherein said excitation signals are generated in accordance with operational data and said feedback data and supplied to said plurality of closed loop circuits, such that said operational data correspond to operational data supplied to said tone generating operators in said acoustic musical instrument being simulated, and said excitation signals correspond to the excitation of said tone generating elements by said tone generating operators in said acoustic musical instrument.

9. A musical tone synthesizing apparatus for synthesizing musical tones comprising:

(a) a plurality of closed loop circuits, each closed loop circuit including delay means having a delay interval corresponding to a pitch of one of said musical tones, wherein said delay interval is capable of being set to have a discrepancy from the delay interval of others of said plurality of closed loop circuits;

(b) feedback means for supplying feedback data from at least one of the plurality of closed loop circuits; and (c) excitation means for creating excitation signals generated in accordance with operational data and said feedback data which are simultaneously supplied to said plurality of closed loop circuits.

10. A musical tone synthesizing apparatus for synthesizing musical tones as set out in claim 9, wherein said excitation means includes means for separately providing a nonlinear excitation function for each of said plurality of closed loop circuits.

* * * * *